United States Patent [19]

Smith

[11] Patent Number: 4,779,556

[45] Date of Patent: Oct. 25, 1988

[54] BOAT WITH SECTIONAL HULL ASSEMBLY HELD BY GEODETICALLY ORIENTED TENDONS

[76] Inventor: David A. Smith, 21460 Encino Rd., Topanga, Calif. 90290

[21] Appl. No.: 537,486

[22] Filed: Sep. 30, 1983

Related U.S. Application Data

[63] Continuation of Ser. No. 259,152, Apr. 30, 1981, abandoned, which is a continuation-in-part of Ser. No. 104,423, Dec. 17, 1979, abandoned.

[51] Int. Cl.[4] ..... B63B 7/04

[52] U.S. Cl. ..... 114/352

[58] Field of Search ..... 114/352-354, 114/77 R, 77 A

[56] References Cited

U.S. PATENT DOCUMENTS

| | | | |
|---|---|---|---|
| 494,288 | 3/1893 | Clark et al. | 114/352 |
| 842,349 | 1/1907 | Skene | 114/352 |
| 1,549,153 | 8/1925 | Scheff | 114/352 |
| 1,693,175 | 11/1928 | Diehl | 114/352 |
| 2,129,788 | 9/1938 | Scruggs | 114/352 |
| 2,415,495 | 2/1947 | Humphreys | 114/352 |
| 2,457,010 | 12/1948 | Thedick | 114/352 |
| 3,381,322 | 5/1968 | Cook | 114/352 |
| 3,787,911 | 1/1974 | Miya | 114/352 |

FOREIGN PATENT DOCUMENTS

| | | | |
|---|---|---|---|
| 1294036 | 4/1962 | France | 114/352 |
| 10541 | of 1911 | United Kingdom | 114/352 |
| 407491 | 3/1934 | United Kingdom | 114/352 |

*Primary Examiner*—Joseph F. Peters, Jr.
*Assistant Examiner*—Jesus D. Sotelo
*Attorney, Agent, or Firm*—Pretty, Schroeder, Brueggemann & Clark

[57] ABSTRACT

A boat having a plurality of separable water-tight transverse sections combined end-to-end to form a hull assembly. A pair of tendons extend longitudinally along the hull assembly and are attached to the bow and stern sections. The tendons follow goedetic lines along opposite sides of the longitudinal center line of the hull below the waterline and below the neutral axis.

3 Claims, 2 Drawing Sheets

Fig. 9
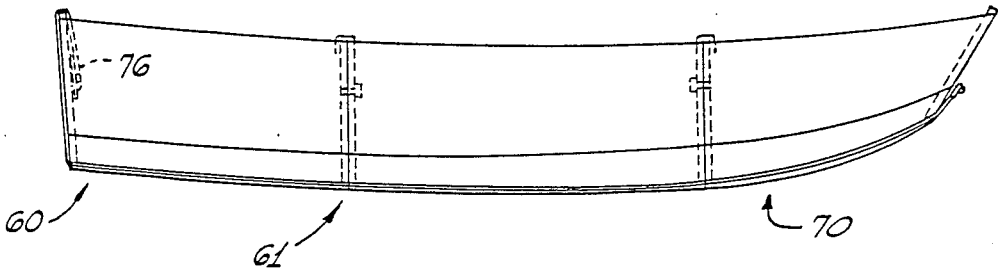
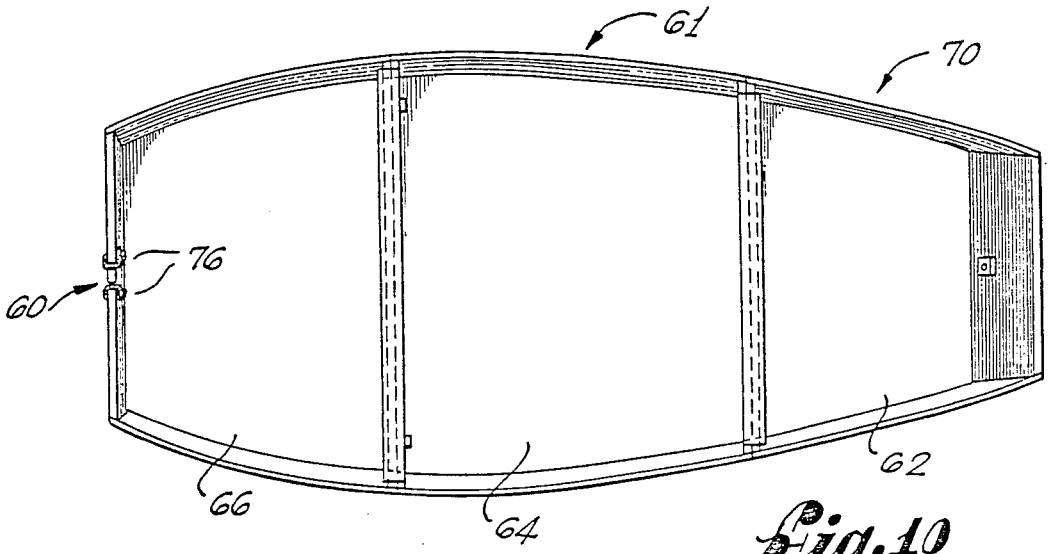
Fig. 10
Fig. 11
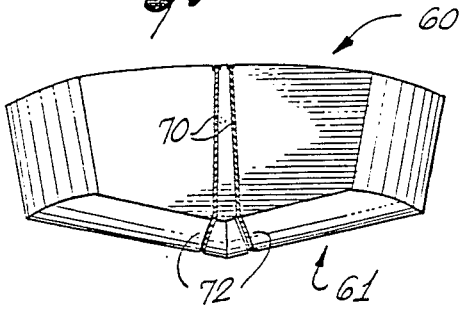
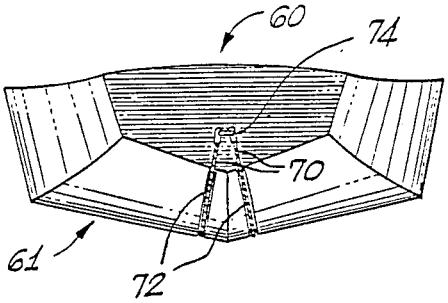
Fig. 12

BOAT WITH SECTIONAL HULL ASSEMBLY HELD BY GEODETICALLY ORIENTED TENDONS

RELATED APPLICATIONS

This is a continuation of abandoned application Ser. No. 06/259,152, filed on Apr. 30, 1981, which is in turn a continuation-in-part of abandoned application Ser. No. 104,423, filed on Dec. 17, 1979.

FIELD OF THE INVENTION

The present invention relates to boats, and, more particularly, to disassemblable boats that are formed in sections.

BACKGROUND OF THE INVENTION

The assembly of the hull of a small boat by combining transverse sections has a number of important advantages. It is particularly advantageous when storing or transporting the boat. For example, many smaller cruising boats are ill suited to carrying a rigid, non-inflatable lifeboat or a dinghy for use in reaching shore once the larger boat has been moored. However, a rigid lifeboat or a dinghy that can be disassembled may be more easily stored on deck or below deck. Conventionally constructed boats used for fishing, sailing, and other recreational activities are often transported by automobiles or small trucks and must be carried by trailer, whereas a disassemblable boat might be carried on the vehicle itself.

There are, however, a number of significant disadvantages associated with boats formed of separable sections that may account for their lack of popularity. The assembly of such boats so that their sections are secured together in an acceptable manner can be a difficult and time-consuming project. Many times, the construction is such that the sections cannot be assembled in the water, thereby defeating many of the potential advantages of a disassemblable boat since room must be available in which to assemble it and sufficient personnel or equipment must be available to lift it into the water after it has been assembled. Obviously, a boat which requires time-consuming out of the water assembly is entirely unsuitable for use as a lifeboat.

Another serious problem that may be encountered with disassemblable boats is that of leakage. Whenever connections are required below the waterline, it is common to use through fasteners around which leakage can occur.

A principal objective of the present invention is to provide a disassemblable boat of sectional construction which avoids the problems and disadvantages mentioned above.

SUMMARY OF THE INVENTION

The present invention resides in a boat that includes a hull assembly formed by a combination of transverse sections, including a bow section and a stern section. A pair of tendons extend longitudinally along the hull assembly, being held by attachment devices that keep them in tension, thereby preventing separation of the sections. The tendons follow geodetic lines along the hull, being positioned on opposite sides of the longitudinal hull center line, below the waterline and below the neutral axis. The tendons are best situated on the keelmost panels of the hull and below the chines. Preferably, the tendons are positioned in open grooves on the exterior surface of the boat hull but are held in the grooves by tension alone.

An attachment means is provided for securing the tendons to the hull and holding them in tension. Preferably, it consists of a towing eye at the bow and tensioning means inside the stern section for tensioning the tendons against the eye.

The tendons can be used in combination with through fasteners that connect adjacent sections above the waterline with the tendons preventing separation beneath the waterline. It is preferable that the various sections be shaped and dimensioned so that they can be internested as a further aid to storage with a minimum of space occupied.

Other features and advantages of the present invention will become apparent from the following detailed description, taken in conjunction with the accompanying drawings, which illustrate, by way of example, the principles of the invention.

BRIEF DESCRIPTION OF THE DRAWINGS

FIG. 9 is a side elevation, similar to FIG. 1, showing a second boat constructed in accordance with the invention;

FIG. 10 is a plan view of the boat of FIG. 9;

FIG. 11 is an elevational view of the stern of the boat of FIG. 9; and

FIG. 12 is an elevational view of the bow of the boat of FIG. 9.

DESCRIPTION OF THE PREFERRED EMBODIMENTS

Figure 8:
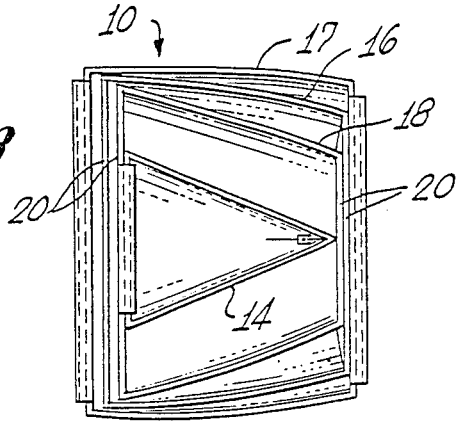
FIG. 8 is a plan view of the boat in a disassembled condition with the sections internested.

An exemplary boat 10, constructed in accordance with the present invention and shown in FIGS. 1–8 of the accompanying drawings, includes a hull assembly 12 formed by four transverse sections 14, 16, 17 and 18 arranged end-to-end. The sections 14, 16, 17 and 18 each form a water-tight enclosure that is open only at the top. When disassembled, the sections 14, 16, 17 and 18 can be internested as shown in FIG. 8. The second mid-section 17 is the largest in each dimension so that it can receive the first mid-section 16 which in turn receives the stern section 18. The bow section 14, which is the smallest, fits within the stern section 18.

The sections 14, 16, 17 and 18 can be made, for example, of fiberglass-resin, metal or wood. Alternatively, they can be of laminated construction, preferably using a low density core. The lines of this particular hull 12 assemly, while exhibiting a compound curvature, can be developed from plywood.

The mid sections 16 and 17 are each closed at the fore and aft ends by transverse bulkheads 20, which are partitions of about the same height as the vertical sides 22 of the boat 10 or slightly less. At the aft end of the bow section 14 is a similar bulkhead 24 that mates with and is contiguous with the fore bulkhead 20 of the first mid-section 16. In a similar manner, a fore bulkhead 26 on the stern section 18 mates with the aft bulkhead 20 of the second mid-section 17.

Figure 1:
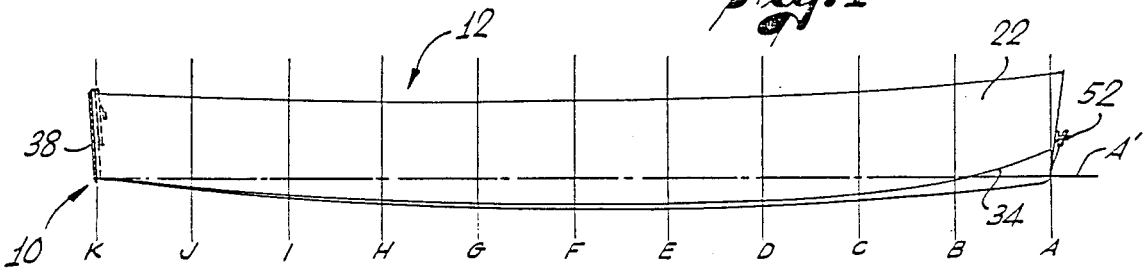
FIG. 1 is a side elevation of an assembled boat constructed in accordance with the invention.
Figure 2:
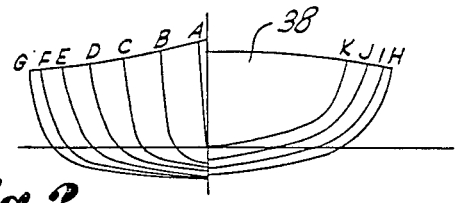
FIG. 2 is a diagrammatic illustration of the hull configuration in which the lines A–K correspond to similar lines indicated in FIG. 1.
Figure 4:
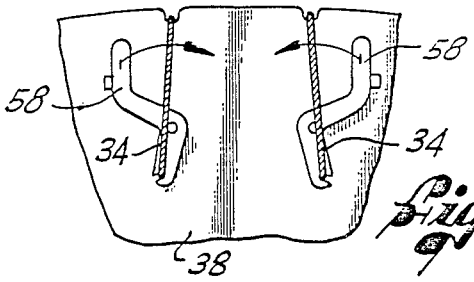
FIG. 4 is an enlarged fragmentary view of a portion of the inside of the transom, taken as indicated by the arrow 4—4 of FIG. 3 and showing the attachment of the aft end of the tendon.
Figure 3:
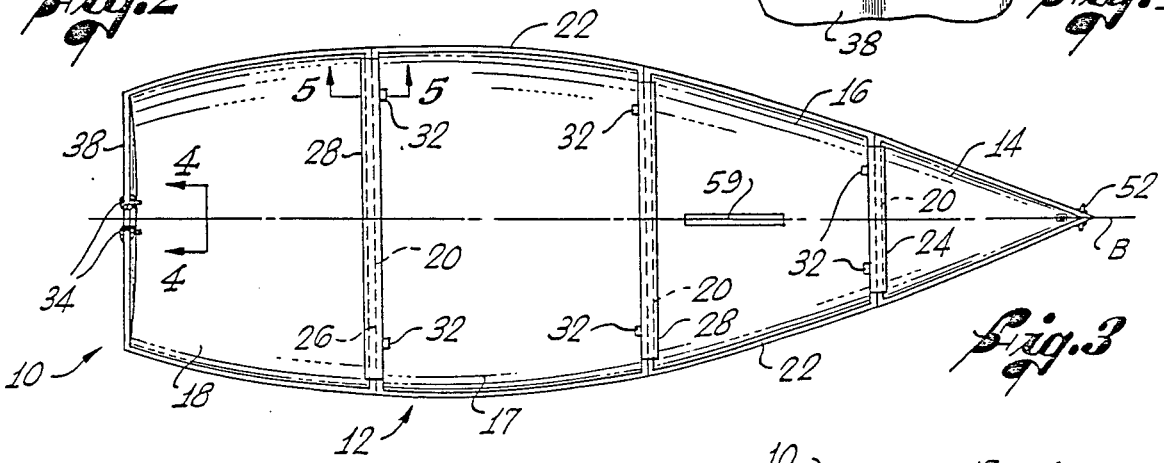
FIG. 3 is a plan view of the assembled boat.
Figure 5:
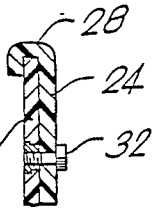
FIG. 5 is an enlarged view of a fragmentary portion of FIG. 1, as indicated by the arrow 1*a*, that shows an interlock between hull sections.

As an aid in assembling the hull 12 and aligning the sections 14, 16, 17 and 18, the bulkheads 20 of the mid-sections 17 and 18 carry lips 28 which extend over and engage the top edges of the adjoining bulkheads 24 and 26 (as best shown in FIG. 3). Thus, the sections 14, 16, 17 and 18 are interlocked and properly positioned.

There are apertures in the mating bulkheads 20, 24 and 26 that receive through fasteners 32. These fasteners 32 are positioned well above the waterline of the hull 12 so that there is no significant leakage around them. Although ordinary marine bolts can be used, the preferrred fasteners 32 are quarter turn cam lock fasteners of a type conventionally used for marine applications.

It will be noted that once the hull 12 is assembled and placed in the water, any weight in the center of the hull will tend to force the sections 14, 16, 17 and 18 apart at the bottom and together at the top. This is because the buoyancy at the longitudinal outer limits of the hull 12 places the entire floating structure under a substantial bending moment, thereby applying compressive forces at the top and tensile forces at the bottom. There is an imaginary neutral axis "A'" (FIG. 1) extending longitudinally through the hull 12 where the structure is neither in compression nor in tension. To counteract the tendency of the sections 14, 16, 17 and 18 to separate at the bottom, it is necessary to secure them below the waterline (not indicated) because there are practical limits on the strength, rigidity, size and weight of the sections that are obtainable in a structure intended to float.

Figure 6:
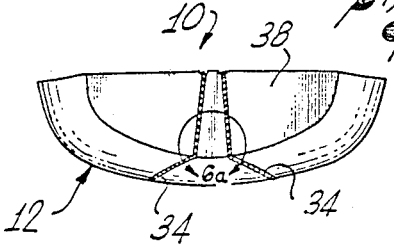
FIG. 6 is an elevational view of the stern of the boat.
Figure 6A:
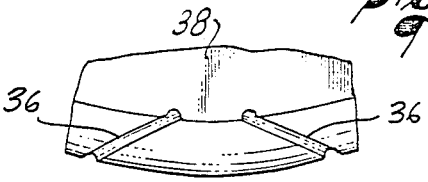
FIG. 6*a* is an enlarged fragmentary view of a portion of the stern section, taken as indicated by the arrow 6*a* in FIG. 6, the cables being omitted to show the grooves.
Figure 7:
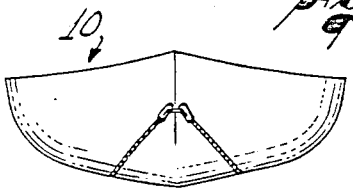
FIG. 7 is a end elevational view of the bow of the boat.

Attachment of the sections 14, 16, 17 and 18 below the waterline is accomplished by two corrosion-resistant, woven steel tendons 34 that extend along the hull 12 from the bow to the stern. To receive these tendons 34, two downwardly facing longitudinal grooves 36 are provided, each extending along the bottom of the entire hull assembly 12 (see FIG. 6*a*).

The lines followed by the tendons 34 and the grooves 36 are geodetic. That is, they are lines on the external surface of the hull 12 naturally followed by the tendons 34 when in tension, i.e., they are the shortest lines between the points at which the tendons are secured to the hull. Thus, it is not necessary to manually position the tendons 34 along the length of the grooves 36. The tendons 34 naturally fall into the grooves 36 when stretched over the hull 12 and tend to resist forces that would displace them laterally out of the grooves. However, the use of the grooves 36 prevents the tendons 34 from chafing against the hull 12. The grooves 36 also prevent the tendons 34 from snagging on underwater obstacles and debris and protect the tendons when the boat 10 is beached.

To hold the tendons 34 is tension, they are commonly held at their fore ends by an eye 52 (FIG. 3), which is referred to as a "towing eye" because it can also serve as an attachment point for a painter. The towing eye 52 should be placed at an appropriate height to serve this dual purpose. The aft ends of the tendons 34 extend up the outside of the transom 38, over the top edge, and are releasably secured to over-center levers 58 that are permanently mounted on the interior surface of the transom above the waterline and inside the stern section 18. Once the over-center levers 58 have been latched, they firmly secure the hull sections 14, 16, 17 and 18 together along their adjoining lower edges.

It should be noted that the hull 12 is symmetrical, the tendons 34 being equally spaced from, opposite sides of the longitudinal hull center line "B'" passing on opposite sides of the center board trunk 59 and any rudder assembly (not shown). The tendons 34 must be located below the neutral axis "A'" and below the waterline of the hull 12.

One important advantage to the use of two tendons 34 is that they provide redundance, keeping the hull 12 essentially intact and operational if one tendon should fail. To minimize the asymmetry in the event that one tendon 34 should fail, the geodetic lines chosen should be close to the longitudinal center line "B" (FIG. 3) or the keel if there is one. In addition, placement of the tendons 34 close to the center line "B" displaces them as far as possible from the neutral axis "A'" thereby giving the tendons the maximum holding power for their tensile strength.

There are no apertures in the hull 12 below the waterline to serve as sources of leakage. Moreover, each of the hull sections 14, 16, 17 and 18 can be made to float by itself, permitting the boat 10 to be assembled in the water. Very little time or skill is required to assemble the boat 10. Once disassembled, it requires a minimum of space since the hull sections 14, 16, 17 and 18 can be internested and the tendons 34 can be coiled and placed inside the sections.

The principles of the invention are further illustrated by a second boat 60, shown in FIGS. 9–12. The hull 61 includes three hull sections 62, 64 and 66 instead of four as in the case of the boat 10. There are two tendons 70 that extend symmetrically along geodesic lines of the hull 61, lying in grooves 72. At the bow, the tendons 70 are attached to a towing eye 74 while in the stern section 68 they are held in tension by over-center levers 76.

The principal difference between the boat 10 and the boat 60 lies in the shape of the hull 61. Although the hull 61 is less efficient, having a less complex curvature with hard chines, its construction is less difficult to fabricate and less, expensive. The placement of the tendons 70, however, is similar to that of the first boat 10, being below the neutral axis and near to the center line. The tendons 70 are, in accordance with the parameters given above, below the lowest chines of the hull 61 and on the keel most panels of the hull.

While particular forms of the invention have been illustrated and described, it will be apparent that various modifications can be made without departing from the spirit and scope of the invention.

I claim:

1. A boat comprising:

at least three separable, water-tight, transverse sections combined end-to-end to form a hull assembly having a compound, convex external curvature, said plurality of sections including at least a bow section, a mid-section, and a stern section, said sections including adjoining, transverse bulkheads, and said sections being shaped and dimensioned to be internested when disassembled;

interlocking means carried by at least one of said sections for positioning said sections in proper alignment;

a plurality of fastening means extending through said bulkheads above the waterline of said hull assembly for separately connecting adjacent ones of said sections to each other;

a symetrically arranged pair of flexible steel tendons extending externally and longitudinally along said hull assembly from a connection point at the bow to a connection point at the stern, below the waterline and below the neutral axis thereof and on opposite sides of the longitudinal center line each of said tendons following a curved geodesic line along a compound, convex curvature of an exterior surface of said hull assembly and following the shortest path outside said hull assembly between said connection points, said hull being free of tendons above the waterline and above the neutral axis;

attachment means secured to the bow of said hull assembly for attaching both of said tendons;

tensioning means mounted in said stern section at said stern connection points for tensioning said tendons against said attachment means; and a pair of open longitudinal grooves defined by said hull assembly within which said tendons are disposed, said grooves extending along said geodesic lines and said tendons being held in said grooves by tension alone.

2. The boat of claim 1 wherein said hull assembly defines chines, said tendons being positioned beneath said chines.

3. A boat comprising:

at least three separable, water-tight, transverse sections combined end-to-end to form a hull assembly having a compound, convex external curvature, said plurality of sections including at least a bow section, a mid-section, and a stern section, said sections including adjoining, transverse bulkheads, and said sections being shaped and dimensioned to be internested when disassembled;

interlocking means carried by at least one of said sections for positioning said ssctions in proper alignment;

a plurality of fastening means extending through said bulkheads above the waterline of said hull assembly for separately connecting adjacent ones of said sections to each other;

a symetrically arranged pair of flexible steel tendons extending externally and longitudinally along said hull assembly from a connection point at the bow to a connection point at the stern, below the waterline and below the neutral axis thereof and on opposite sides of the longitudinal center line, each of said tendons following a curved geodesic line along a compound, convex curvature of an exterior surface of said hull assembly and following the shortest path outside said hull assembly between said connection points, said hull being free of tendons above the waterline and above the neutral axis;

attachment means secured to said bow section at said bow connection points for attaching said tendons to said bow connection points;

tensioning means mounted on said stern section at said stern connection points for tensioning said tendons against said attachment means; and a pair of open longitudinal grooves defined by said hull assembly within which said tendons are disposed, said grooves extending along said geodesic lines from said attachment means, said tensioning means, and said tendons being held in said grooves by tension alone.

* * * * *